US009179705B2

(12) United States Patent
Yang

(10) Patent No.: US 9,179,705 B2
(45) Date of Patent: Nov. 10, 2015

(54) TABLETOP AUTOMATIC CIGARETTE-MAKING MACHINE

(75) Inventor: Jinjuan Yang, Fuyang (CN)

(73) Assignee: REPUBLIC TOBACCO L.P., Glenview, IL (US)

( * ) Notice: Subject to any disclaimer, the term of this patent is extended or adjusted under 35 U.S.C. 154(b) by 876 days.

(21) Appl. No.: 13/449,823

(22) Filed: Apr. 18, 2012

(65) Prior Publication Data

US 2013/0276795 A1 Oct. 24, 2013

(51) Int. Cl.
*A24C 5/06* (2006.01)
*A24C 5/40* (2006.01)

(52) U.S. Cl.
CPC .... *A24C 5/06* (2013.01); *A24C 5/40* (2013.01)

(58) Field of Classification Search
USPC ..... 131/70, 111, 112
See application file for complete search history.

(56) References Cited

U.S. PATENT DOCUMENTS

| | | | | |
|---|---|---|---|---|
| 3,809,831 | A * | 5/1974 | Godwin et al. | 200/38 C |
| 3,886,952 | A | 6/1975 | Kastner | |
| 4,215,705 | A | 8/1980 | Marcil | |
| 5,088,506 | A | 2/1992 | Kastner | |
| 6,913,022 | B2 * | 7/2005 | Moser et al. | 131/70 |
| 8,261,752 | B2 * | 9/2012 | Bao | 131/70 |
| 2004/0099277 | A1 | 5/2004 | Moser et al. | |
| 2007/0044812 | A1 | 3/2007 | Juan | |

FOREIGN PATENT DOCUMENTS

| | | | |
|---|---|---|---|
| CN | 201138314 | Y | 10/2008 |
| CN | 101986903 | A | 3/2011 |
| DE | 3914669 | A1 | 11/1990 |
| EP | 1844668 | A2 | 10/2007 |
| EP | 1872672 | A1 | 1/2008 |
| GB | 464948 | A | 4/1937 |
| GB | 726742 | A | 3/1955 |
| GB | 2457142 | A | 8/2009 |
| WO | 2007125425 | A2 | 11/2007 |
| WO | 2011127500 | A1 | 10/2011 |
| WO | 2012167369 | A1 | 12/2012 |

OTHER PUBLICATIONS

Search report issued in related application GB1216783.9, Jan. 17, 2013, 2 pages.
Patent Examination Report issued in related application AU2012227173, dated Oct. 18, 2013,3 pages.
Search Report issued in related application P.401248 (and English translation), dated Jan. 15, 2013, 2 pages.

* cited by examiner

*Primary Examiner* — Sing P Chan
(74) *Attorney, Agent, or Firm* — Drinker Biddle & Reath LLP

(57) ABSTRACT

A cigarette-making machine of the tobacco-injecting type including a housing with an aperture and a compacting chamber in communication with the aperture for receiving loose tobacco, a compacting member mounted for reciprocal up and down motion from an initial position adjacent the top of the compacting chamber toward the bottom of the compacting chamber, an injection spoon mounted for reciprocal lateral movement from a rest position within the compacting chamber across the compacting chamber to transport rod-like compacted tobacco shapes past the ejection side of the compacting chamber, through the nipple and into a hollow cigarette tube, an electrically powered motor, and a dual purpose control disk adapted to be rotated about its axis by the motor to initially move the compacting member up and down in the compacting chamber and then to move the injection spoon across the compacting chamber as the control disk is rotated by the motor.

16 Claims, 9 Drawing Sheets

TABLETOP AUTOMATIC CIGARETTE-MAKING MACHINE

FIELD

This invention pertains generally to injector-type cigarette-making machines, and, more particularly, to compact tabletop automatic injector-type cigarette-making machines and methods of using such cigarette-making machines.

BACKGROUND

Manual injector-type cigarette-making machines are well known. Such cigarette-making machines are typically operated by rotating a crank to first compress a selected portion of loose tobacco equivalent to one cigarette within a compaction chamber and then to inject the compressed tobacco into a pre-formed cigarette tube by means of a plunger that carries the tobacco into the tube. The pre-formed empty cigarette tube is held at one end of a hollow nipple of the cigarette-making machine during the injection of the compressed tobacco. Once the compressed tobacco is in place in the pre-formed cigarette tube, the tube is released from the cigarette-making machine to be smoked or stored for later use.

Many of the prior manual injector-type cigarette-making machines are often considered slow and cumbersome to use, particularly when it is desired to make a substantial number of cigarettes. Current automatic machines, on the other hand, are typically large, complex, expensive and difficult to use, making them impractical for individuals making cigarettes for their own use. Also, many of these complex and expensive automatic cigarette-making machines require careful calibration and produce many less than optimal cigarettes. Furthermore, complex prior art automatic cigarette-making machines are vulnerable to breakdown and expensive repairs.

It is therefore an object of the present invention to provide a compact automatic cigarette-making machine which consistently and efficiently produces cigarettes using a mechanism that is neither complex nor requires adjustment or expensive repairs.

BRIEF SUMMARY

The invention is a cigarette-making machine having a housing with an aperture in communication with a compacting chamber designed to receive loose tobacco. A compacting member reciprocates in an up and down motion from an initial position adjacent the top of the compacting chamber toward the bottom of the compacting chamber to compact the loose tobacco in the chamber into a rod-like shape. Preferably the leading edge of the compacting member is concave to help form the top of the compacted tobacco rod-like shape.

A nipple is provided for receiving a hollow cigarette tube adjacent a delivery side of the compacting chamber. In a preferred embodiment, a tube holding mechanism is present in which a pressure applying member with an elastomeric tip captures a portion of the tube over the nipple during the cigarette filling process. In further preferred embodiments, this member will release the tube once the filling process is complete so that the fully filled cigarette may be removed.

The cigarette-making machine also includes an injection spoon mounted for reciprocal lateral movement from a rest position within the compacting chamber across the compacting chamber. The spoon transports the rod-like compacted tobacco shape past the delivery side of the compacting chamber, through the nipple and into a hollow cigarette tube.

The device is operated by an electrically powered motor. A dual purpose control disk is adapted to be rotated about its axis by the motor. This may be done by placing a drive gear on the axle on the shaft of the motor and gear teeth along the circumference of the control disk. In other embodiments the control disk may be driven by conventional friction means such as engaging rubber wheels or drive belts.

The compacting member is coupled to a first member associated with a face of the control disk that moves the compacting member up and down in the compacting chamber as the control disk is rotated by the motor. This may be accomplished with a heart-shaped drive slot and a pin that moves within the drive slot as the control disk is rotated. The injection spoon is coupled to a second member associated with the control disk axle which moves the injection spoon across the compacting chamber as the control disk is rotated by the motor.

The cigarette-making machine may include a funnel portion having an inclined surface for directing loose tobacco into the compacting chamber.

DETAILED DESCRIPTION OF EXEMPLARY EMBODIMENTS

The embodiments of the invention described in detail below are not intended to be exhaustive or to limit the invention to the precise structure and operation disclosed. Rather, the described embodiments have been chosen and described to explain principles of the invention and their application, operation and use in order to best enable others skilled in the art to follow its teachings.

Figure 1:
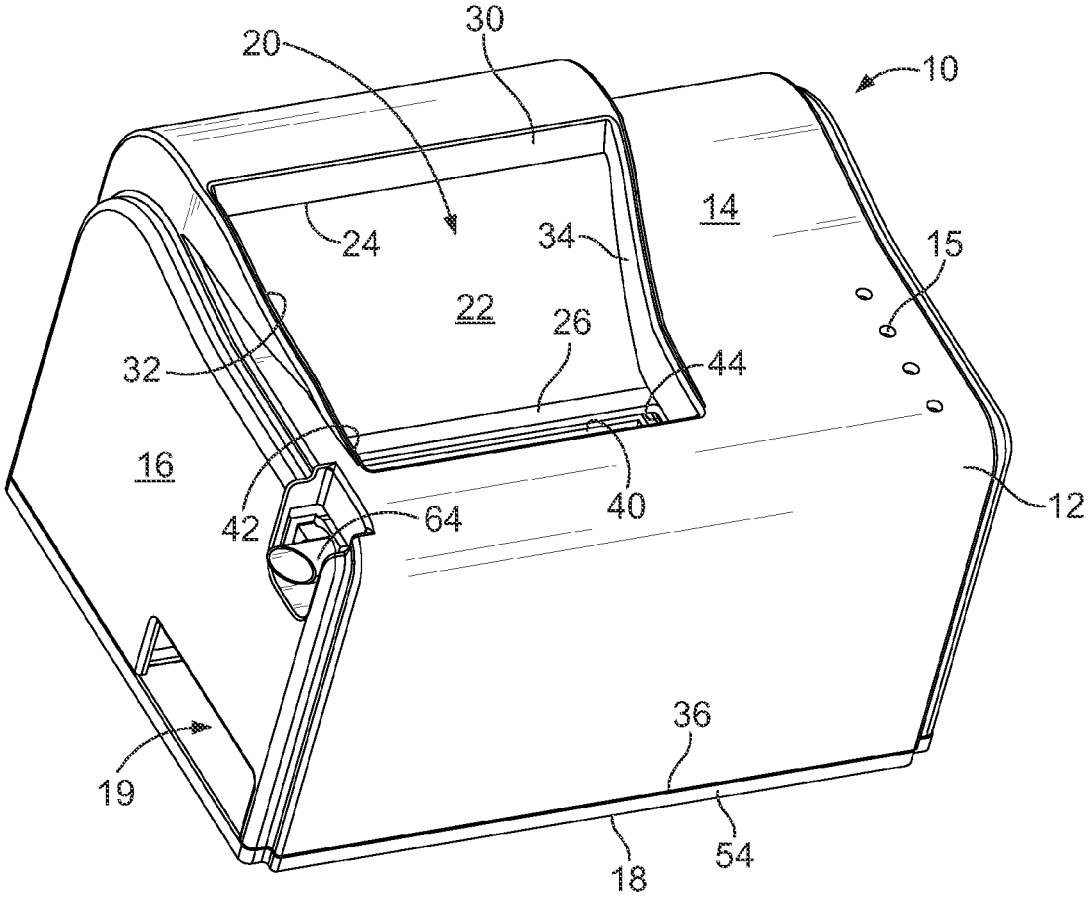
FIG. 1 is a perspective view of a tabletop automatic cigarette-making machine embodiment with the mechanism of the device covered by a formed plastic cover.

Referring now to the Figures, tabletop automatic cigarette-making machine embodiments are provided. In FIG. 1, the exterior of a tabletop automatic cigarette-making machine embodiment 10 is shown, with the mechanism of the device covered by formed plastic cover 12. This cover may, of course, be made of any suitable material, such as plastic, metal, etc. Cover 12 includes a top surface 14, four vertical sides, including a delivery side 16, and a bottom 18. Delivery side 16 may also include a slot 19 for a retractable tray (not shown) to receive finished cigarettes.

Top surface 14 has a funnel portion 20 for receiving loose tobacco. The funnel portion has an inclined surface 22 which is pitched downwardly from its top edge 24 to its bottom edge 26. This inclined surface is spaced from top surface 14 and encircled on three sides by top wall 30 and side walls 32 and 34 to provide a pitched generally flat depression for directing loose tobacco toward bottom edge 26 of the funnel portion. In the illustrated embodiment, side wall 34 is angled inwardly to also move the tobacco inwardly as it is advanced toward bottom edge 26.

At the bottom edge 26 of inclined surface 22, the surface leads into a compacting chamber access opening 40, with side walls 32 and 34 abutting the opposite ends 42 and 44 of the access opening. A tobacco compacting chamber 41 (FIG. 3) lies beneath opening 40. Thus, before the cigarette-making machine is put into operation to form a cigarette, the loose tobacco intended for the cigarette is placed in funnel portion 20 to be directed by the user as assisted by gravity through compacting chamber access opening 40 to compacting chamber 41.

Figure 2:
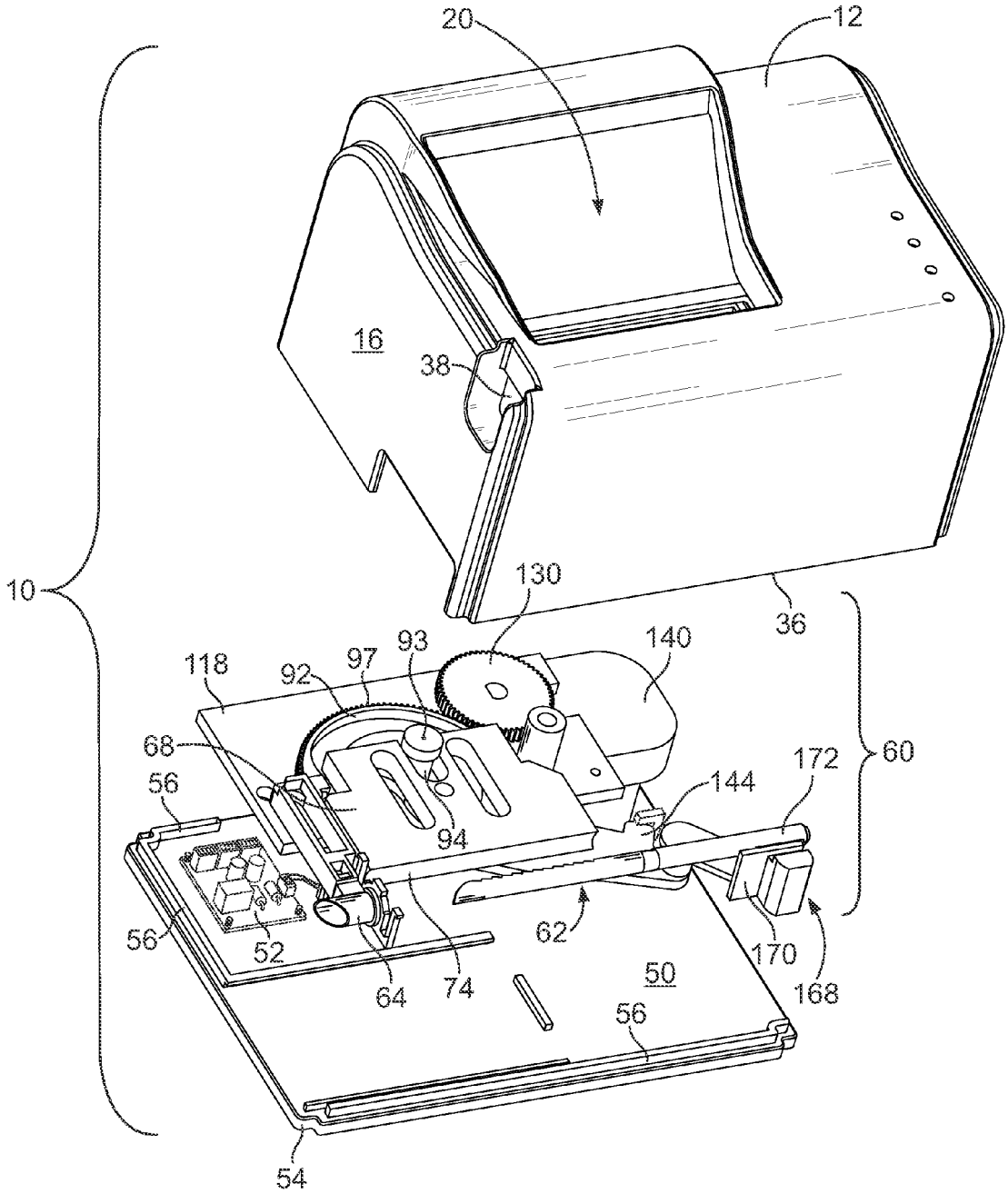
FIG. 2 is an exploded view of the cigarette-making machine embodiment of FIG. 1 which the cover is removed to reveal the base platform and drive mechanism of the machine.

Turning now to FIG. 2, an exploded view of cigarette-making machine 10 is shown with cover 12 removed from the base platform 50 of the machine. Base platform 50 includes a PCB board 52 carrying electronic components and circuitry including appropriate conventional logic components to control the operation of the cigarette-making machine. Power is supplied to PCB board 52 by a line cord (not shown) although the cigarette machine may be battery-powered as well.

Base platform 50 includes an encircling outer edge 54 dimensioned to abut the bottom edge 36 of cover 12 when the cover is assembled to the base platform. The base platform also includes inwardly spaced stub walls 56 (FIGS. 2 and 3) which are positioned to engage the inner surface of cover 12 when the cover is assembled to the base platform.

Drive mechanism 60 of the cigarette-making machine is shown in FIG. 2 juxtaposed above base platform 50. Drive mechanism 60 includes an injection spoon 62 which transports compacted tobacco from the compacting chamber and delivers it through a nipple 64 mounted in an aperture 38 in delivery side 16 of cover 12. A hollow cigarette-tube (not shown) is affixed to the nipple before the delivery of the tobacco to receive the compacted tobacco.

Figure 3:
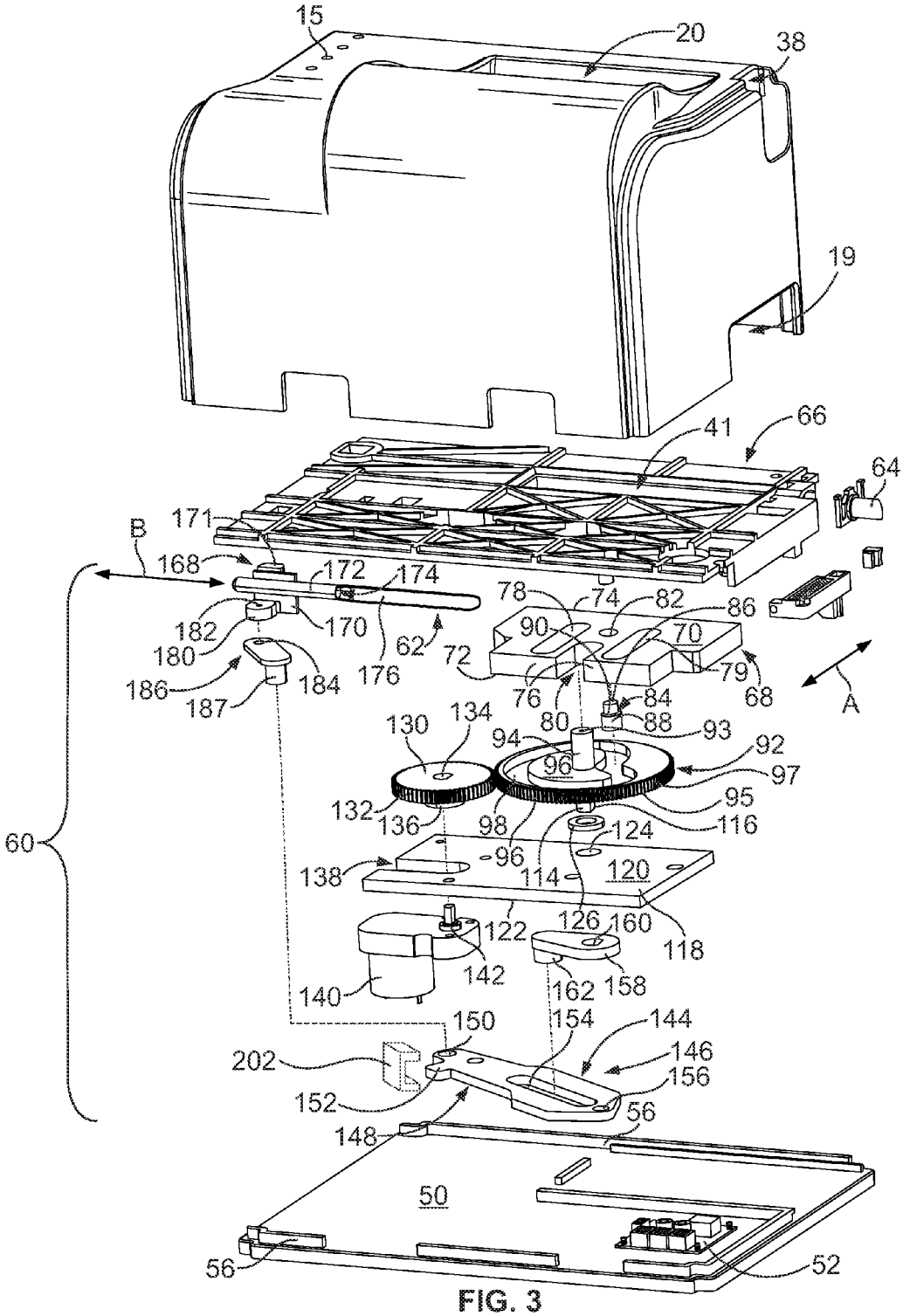
FIG. 3 is a further exploded view of the cigarette-making machine embodiment of FIGS. 1 and 2 in which the machine has been rotated 180° and further details of the drive mechanism and associated features of the machine are revealed.

FIG. 3 is a further exploded view of the cigarette-making machine of FIGS. 1 and 2 in which the machine has been rotated 180 degrees and drive mechanism 60 is shown in an exploded view below a reinforced a top support platform 66 to which the drive mechanism is attached with conventional attachment means (not shown). Tobacco compacting chamber 41 is formed in the support platform.

Drive mechanism 60 thus includes, in addition to injection spoon 62, a reciprocating compacting member 68 which is designed to move up and down from an initial position adjacent the top of the compacting chamber toward the bottom of the compacting chamber in direction "A". Reciprocating compacting member 68 includes a top surface 70, a bottom surface 72 and a leading compacting edge 74. Compacting edge 74 is concave (FIG. 2) to help shape the compacted tobacco into a rod-like shape before it is injected into a cigarette tube, as described below. Reciprocating compacting member 68 also has a back edge 76, as well as a pair of transverse slots 78 and 79 and an edge slot 80 opening up to the back edge 76 of the compacting member. Finally, reciprocating compacting member 68 includes a bore 82 extending perpendicularly between its top and bottom surfaces.

A circular pin 84 is provided having a top smaller diameter portion 86 which is press-fit to bore 82 and a bottom larger diameter portion 88, with a ledge encircling the pin at the transition between the top and bottom portions to help position the pin. Pin 84 engages a dual purpose control gear 92 at its larger diameter portion during the operation of the machine as explained below. Control gear 92 may be a disk without outer gear teeth, driven by conventional friction means and so may be referred to broadly as a dual purpose control "disk".

Dual purpose control gear 92 thus includes a fixed central axle 94 which is perpendicular to and protrudes upwardly from the outer first face 96 of the control gear. The opposed outer second face of the control gear is designated 95. Outer gear teeth 97 encircle the control gear. A heart-shaped drive slot 98 is formed in the face of the gear.

Control gear 92 is mounted on a support plate 118 having a top surface 120, a bottom surface 122, and a bore 124 extending between the two surfaces. Control gear 92 has a downwardly directed keyed shaft 114 having a flat 116 to provide the keying function. Control gear 92 is mounted to the support plate with the keyed axle extending through bore 124 and beyond bottom surface 122 of the support plate. A washer 126 is interposed between the gear and the top surface of the support plate to minimize friction between the gear and the support plate. Support plate 118 also includes a series of holes designed for receiving conventional attachment means for attaching the support plate to top support platform 66.

A drive gear 130 is also mounted to support plate 118. Drive gear 130 includes gear teeth 132 along its outer circular edge. These teeth are designed and positioned to engage outer gear teeth 97 of control gear 92. Drive gear 130 includes a central keyed bore 134 and a downwardly directed central circular collar 136 which rests in a slot 138 in support plate 118.

An electric motor 140 is affixed to bottom surface 122 of the support plate. It is wired to an externally accessible push-button (or other type) on/off switch 15 associated with the electronic circuitry on PCB board 52 (FIG. 1). Motor 140 includes a drive axle 142 that engages keyed bore 134 of drive gear 130 to rotate the drive gear and hence the control gear when the motor is activated.

Drive mechanism 60 further includes an injection spoon drive arm 144 driven by dual purpose control gear 92 as explained below. The injection spoon drive arm has a foot section 146 and a head section 148. Head section includes a further first bore 150 and a lip 152. The foot section includes a longitudinal slot 154 and a second bore 156.

A first link arm 158 is provided to link the injection spoon drive arm to the control gear. Link arm 158 has a keyed bore 160 which receives keyed downwardly directed axle 114. A drive pin 162 is located at the opposite end of link arm 158 and dimensioned as well as positioned to engage longitudinal slot 154 in the injection spoon drive arm. Pin 162 thus moves back and forth along the slot as drive arm 158 rotates causing the arm to swing about a pivot point where it is rotatably fixed at bore 156. In a preferred embodiment, pin 162 will be a bearing-mounted rotatable pin to minimize friction as the pin moves in the slot.

Finally, an injection spoon assembly 168 is provided. The assembly includes a carriage portion 170 to which a spoon base 172 is attached. The spoon base is tubular in shape and plugged at its top 174. An approximately half round open tubular spoon 62 projects from the spoon base. The radius of curvature of this open tubular spoon is approximately the same as that of the front compacting edge 74 of reciprocating compacting member 68.

Carriage portion 170 of the injection spoon assembly includes tracking means 171 projecting from the bottom of the carriage portion to engage a tracking support 173 (FIG. 6A) which confines the movement of the injection spoon assembly and hence the injection spoon to reciprocal lateral movement from a rest position within the compacting chamber across the compacting chamber in direction "B". Additionally, a nub 180 with a central hole 182 projects upwardly from the carriage portion of the spoon assembly. The injection spoon assembly is attached to a second link arm 186 by passing an appropriate fastener through hole 182 in the nub and hole 184 in the second link arm. A drive pin 187 at the opposite end of the second link arm is notably mounted in bore 150 of the injection spoon drive arm.

Figure 4:
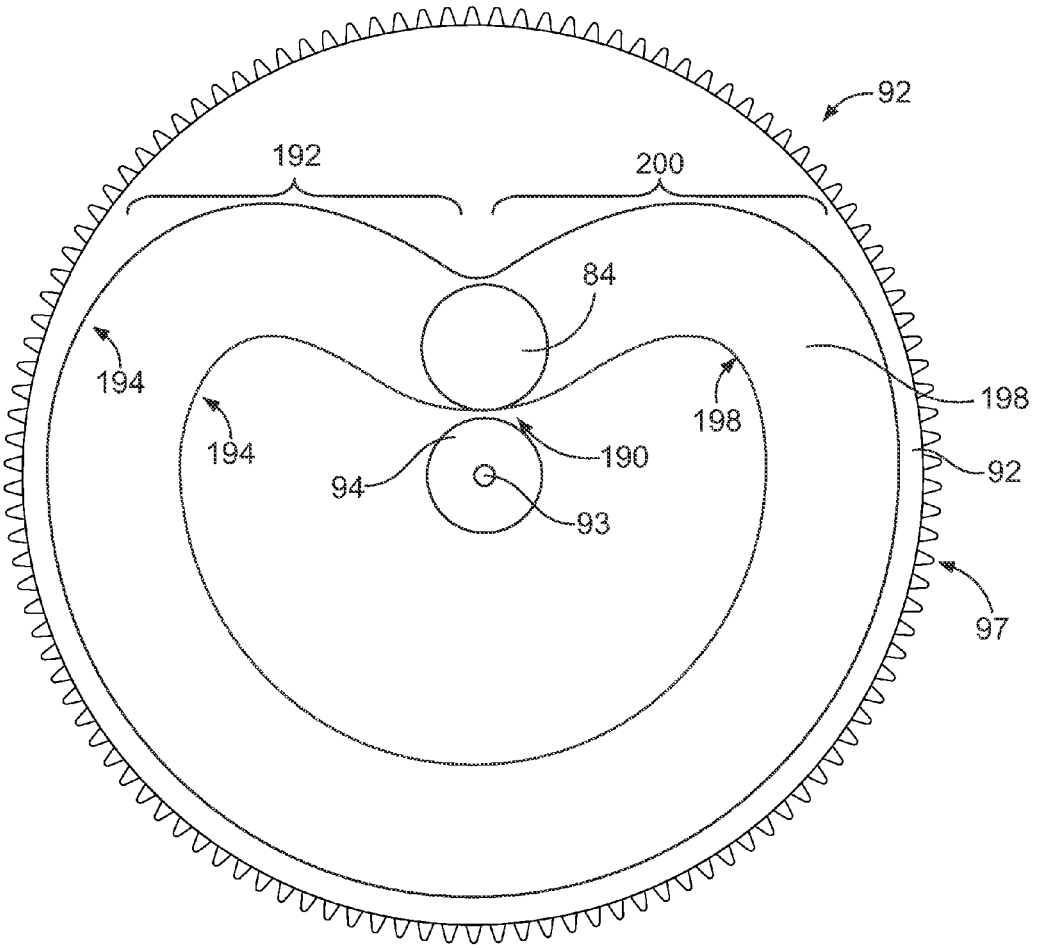
FIG. 4 is a diagrammatic representation of a dual purpose control gear of the invention.

The operation of reciprocating compacting member 68 may be best understood by examining how heart-shaped drive slot 98 of dual purpose control gear 92 causes pin 84 to move away and toward the center of rotation 93 of control gear 92. This may be done by turning to the diagrammatic representation of the control gear and its heart-shaped slot 98 in FIG. 4. As shown in this Figure, heart-shaped slot 98 comprises a rest point 190 where the slot dips to a location closest to center of rotation 93. The first portion of the slot lying between rest position 190 and a first transition point 194 comprises an arc 192 curling up and away from the center of rotation. As control gear 92 rotates in a clockwise direction as in the view depicted in FIGS. 5A-5D, the slot moves pin 84 away from the center of rotation of the gear. This causes reciprocating compacting member 68 to which the pin is attached to move upwardly into tobacco compacting chamber 41 in platform 66.

As the gear continues to rotate, pin 84 will ride along a maintenance segment of the slot 193 running between a first transition point 194 and a second transition point 198. Since the pin is maintained at a generally uniform distance from center of rotation 93 of control gear 92, there is no significant movement in the reciprocating compacting member as the gear rotates. When, however, the pin passes second transition point 198, the slot curves inwardly toward center of rotation 93 of the gear to form a reopening portion of the slot 200. As the pin follows this reopening portion of the slot, it is moved toward center of rotation 93 which causes the reciprocating compacting member to move out of the tobacco compacting chamber.

Figure 5A:
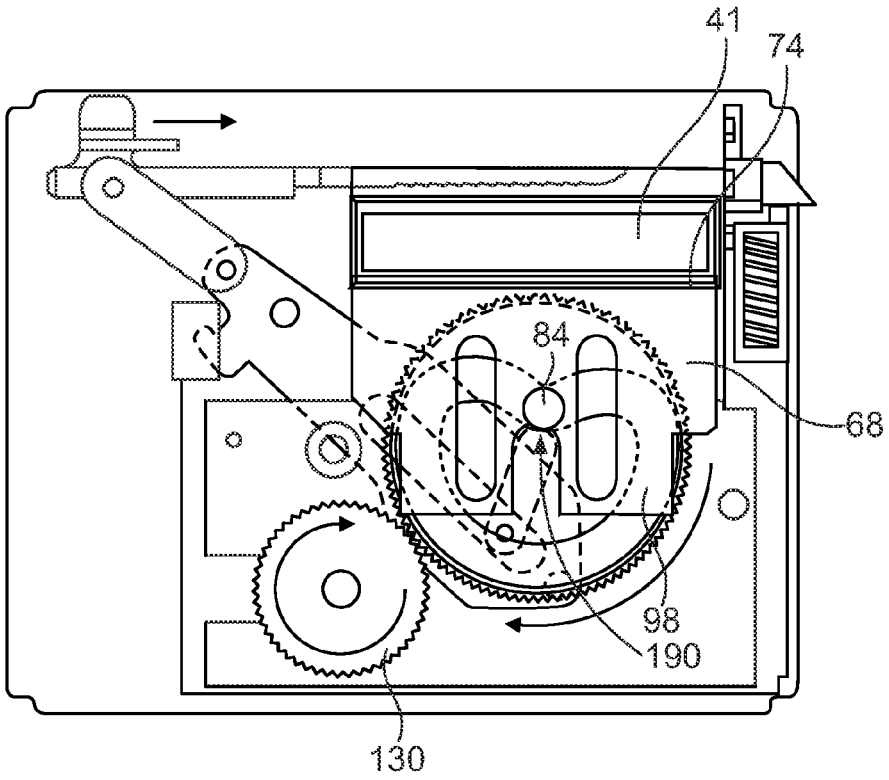
FIGS. 5A-5D are top plan views of an embodiment of the cigarette-making machine in which the cover is removed and the advancing and retracting movement of the reciprocating compacting member of the machine is shown.
Figure 5B:
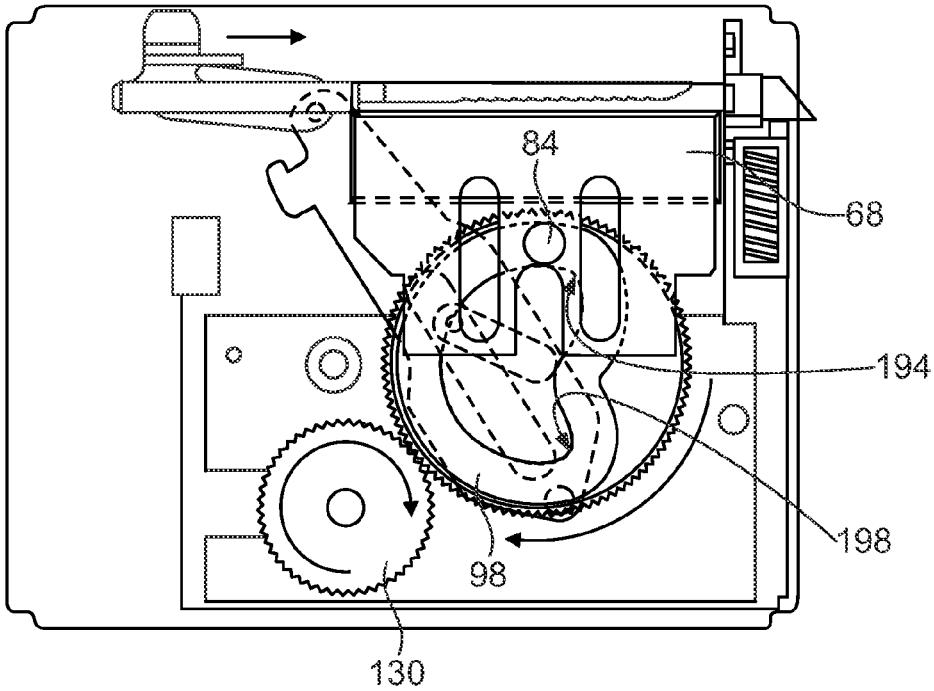
Figure 5C:
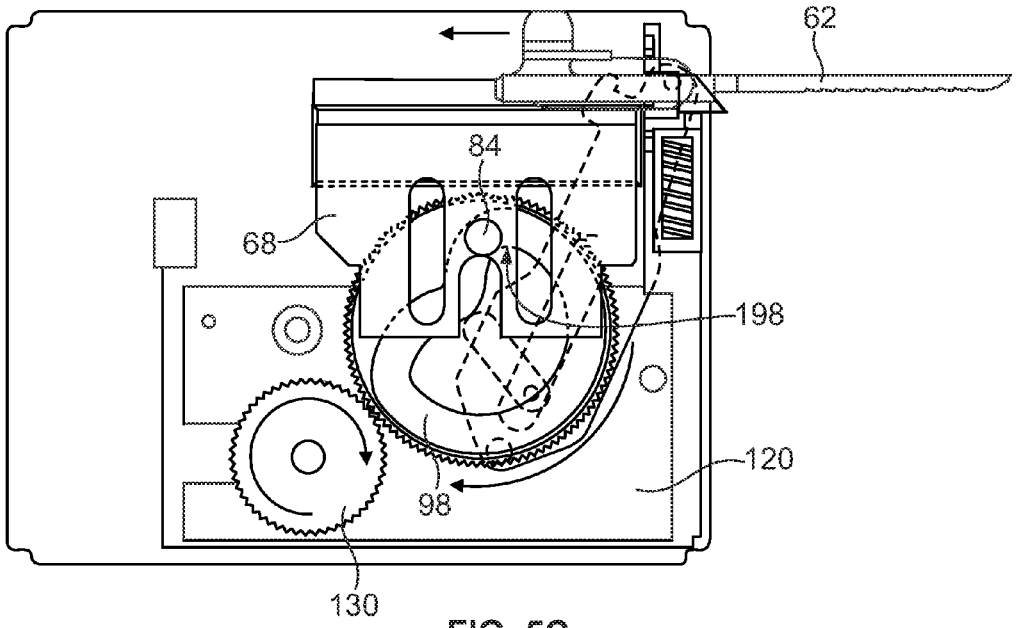
Figure 5D:
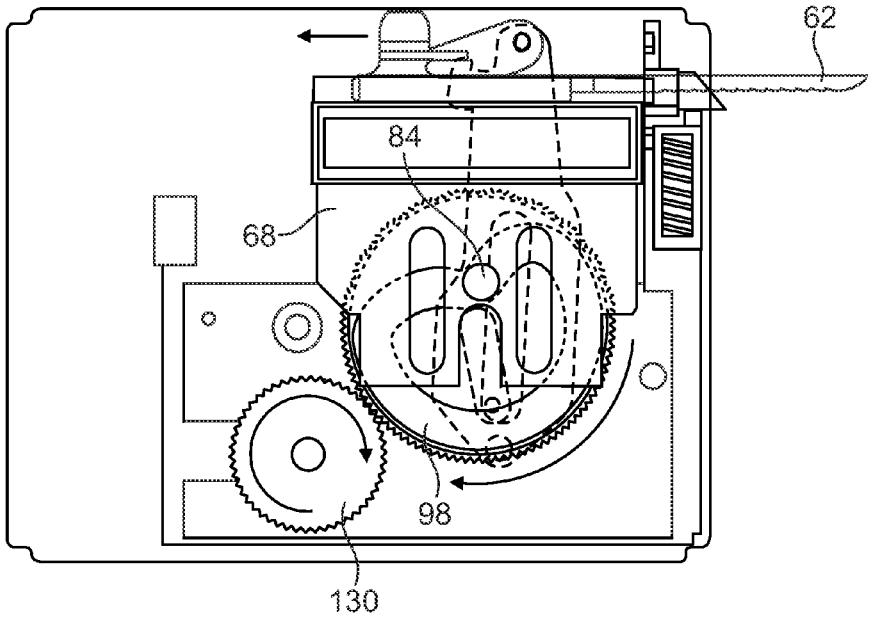

Thus, turning to FIG. 5A, it can be seen that reciprocating compacting member 68 is in an initial position adjacent the top of the compacting chamber. The compacting edge 74 of the compacting member is at rest below compacting chamber 41 which is formed in top support platform 66 and located behind compacting chamber access opening 40 (FIG. 1). Circular pin 84 is at rest point 190 of heart-shaped slot 98 where it dips closest to center of rotation 93 of dual purpose control gear 92. As the gear is rotated clockwise to the view of FIG. 5B, slot 98 moves along the pin past first transition point 194 causing reciprocating compacting member 68 to move upwardly as depicted in the figure to a closed position in which it compacts loose tobacco previously passed through funnel portion 20 and into the compacting chamber. The tobacco is compacted into a rod-like shape between the concave compacting surface of the reciprocating member and the half-round surface of injection spoon 162. The control gear continues to rotate toward the position depicted in FIG. 5C causing slot 98 to move along the pin toward second transition point 198, maintaining the reciprocating compacting member in its closed (compacting) position. As explained above with respect to FIG. 4, as the slot moves along the pin past second transition point 198 it draws the reciprocating compacting member downwardly to the position depicted in FIG. 5D, where the reciprocating compacting member is being withdrawn from compacting chamber 41. When the slot moves past the pin until it is again at rest at point 190 of the slot, the reciprocating compacting member will be in a fully open position, completely clear of the compacting chamber.

Dual control gear 92 not only governs the motion of the reciprocating compacting member, it also simultaneously governs the motion of injection spoon 62 and achieves a unique serial coordination between the closure of the reciprocating compacting member and the movement of the injection spoon into and out of the tobacco-receiving hollow tubes mounted on nipple 64.

Figure 6A:
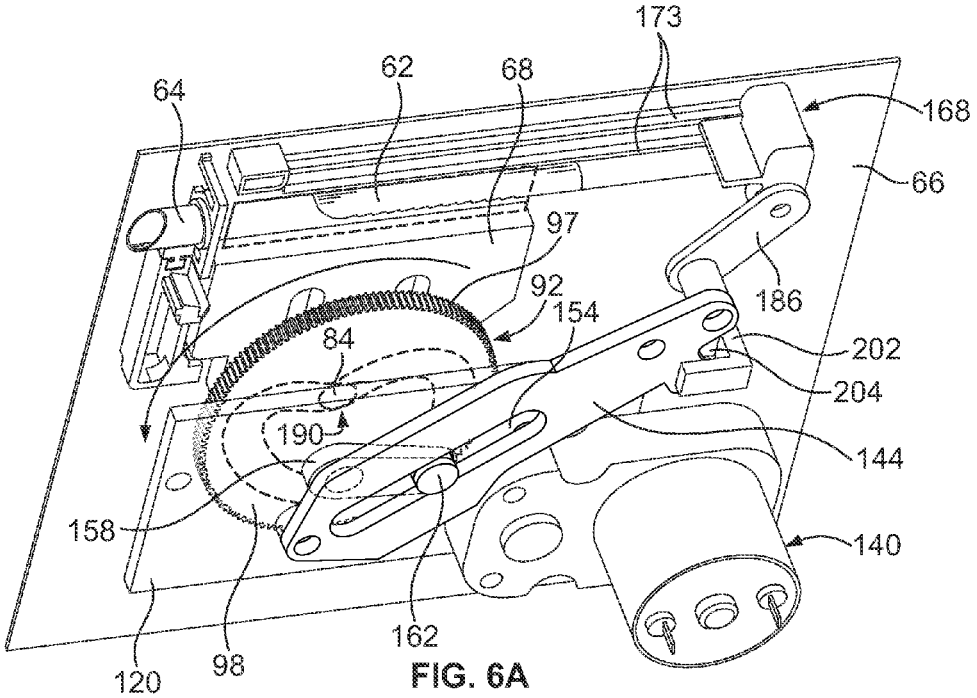
FIGS. 6A-6D are perspective views of the drive mechanism of the cigarette-making machine shown affixed to a top support platform which has been rotated from its horizontal position in the machine to a vertical position to facilitate viewing, in which the movement of the reciprocating compacting member during the operation of the machine is depicted from above.

Thus, turning to FIG. 6A, control gear 92 is in a position corresponding generally to that depicted in FIG. 5A, with rest point 190 of slot 98 at or near the top of the gear as shown and pin 84 at the rest point. At this point in the cycle, injection spoon 62 is in its fully retracted position, as can be seen in FIG. 6A.

Figure 6B:
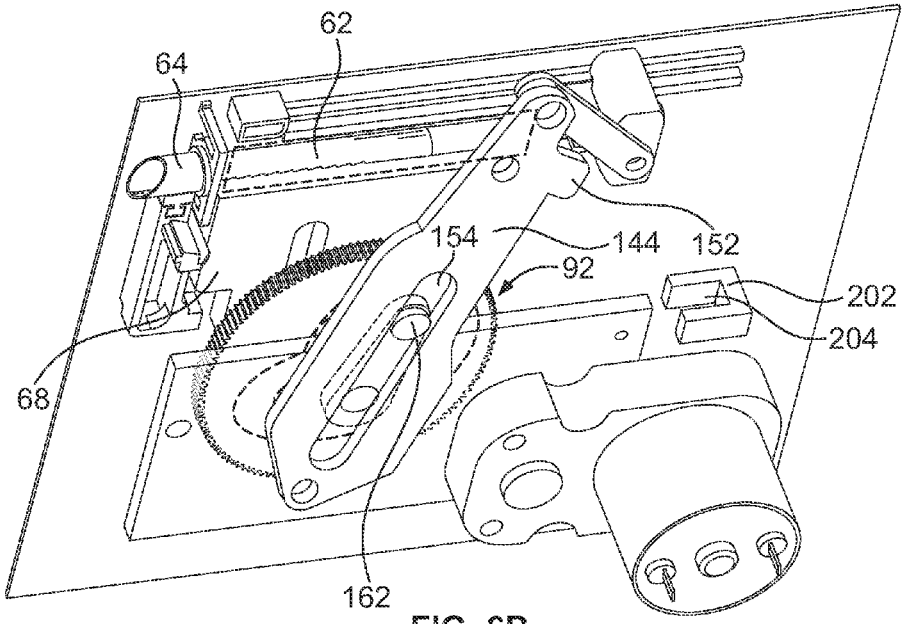
Figure 6C:
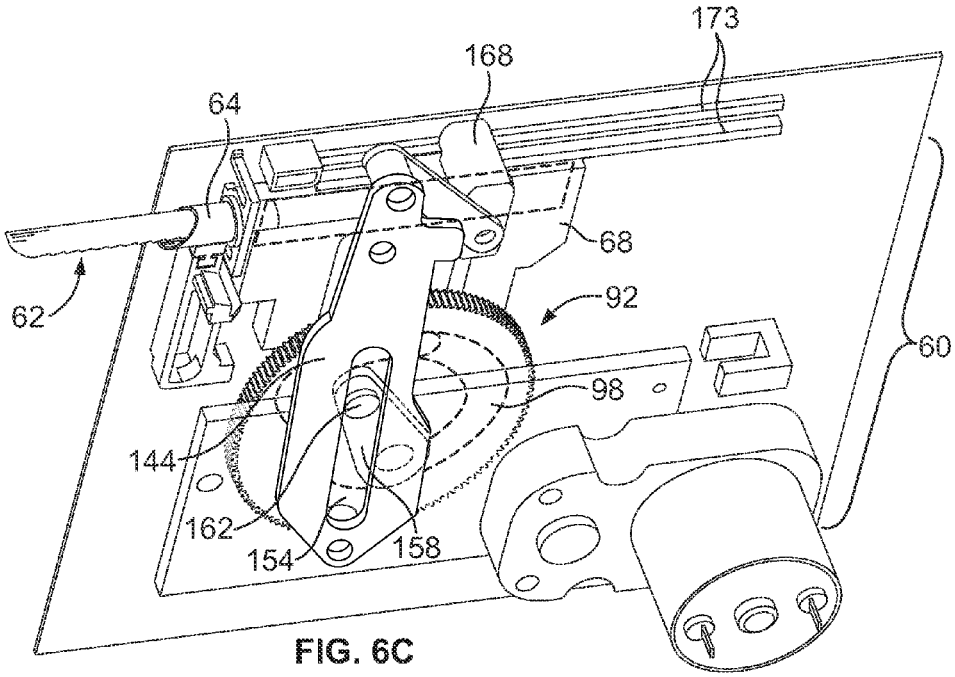

As control gear 92 begins to rotate in a counterclockwise direction in this view, drive pin 162 of link arm 153 moves upwardly along slot 154 of the drive arm. This movement of the drive pin causes injection spoon drive arm 144 to move upwardly toward the position depicted in FIG. 6B. As the injection spoon drive arm moves in this fashion, it moves injection spoon assembly 186 along tracking support 173 by way of second link arm 166 which pivotally interconnects the injection spoon assembly and the injection spoon drive arm. It should be noted that by the time there has been any significant movement of the injection spoon assembly reciprocating compacting member 68 will have already been moved toward the bottom of the compacting chamber to compact loose tobacco in the compacting chamber into a rod-like shape by way of the movement of control slot 98 past circular pin 84 as discussed above with respect to FIGS. 5A-5B.

The continued counterclockwise movement of gear 92 causes drive pin 62 to reach a topmost position in longitudinal slot 154 whereupon the drive pin begins moving downwardly in the slot while continuing to drive the injection spoon assembly in the same direction, to transport the compacted tobacco from the compaction chamber to the hollow cigarette tube (not shown) at the end of nipple 64. (It should be noted that the entire device including drive mechanism 60 and support platform 66 have been rotated to a generally vertical position for illustration purposes but that in operation the device and of course these components would typically be in a generally horizontal position.)

Figure 6D:
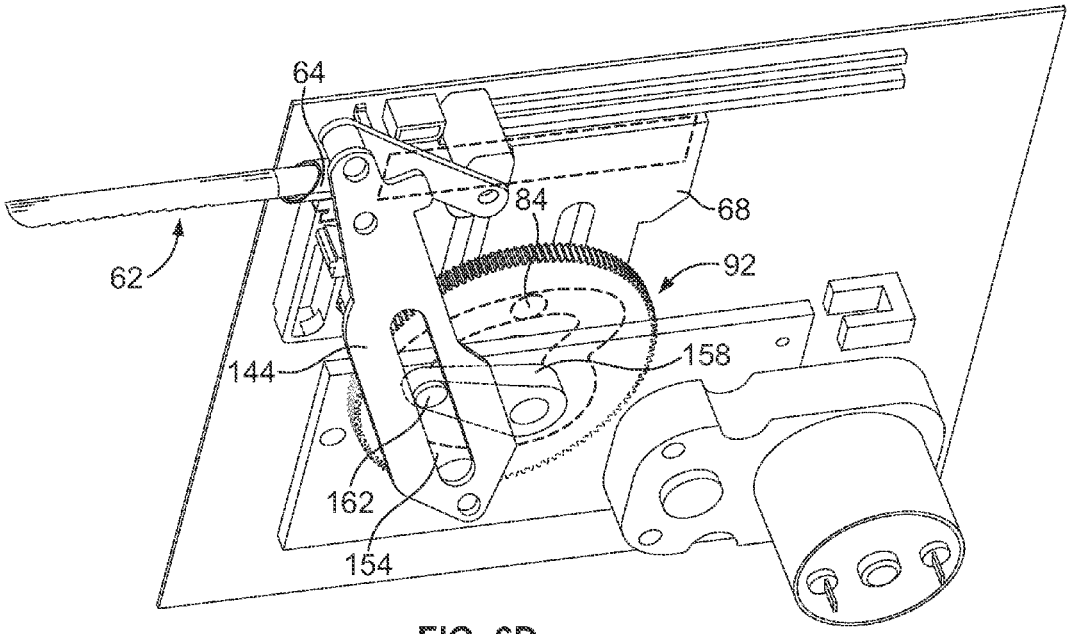

Finally, as shown in FIG. 6D, while reciprocating compacting member 68 is still in a fully closed position, the injection spoon drive arm and the injection spoon assembly reach the end of their leftward movement to complete the injection phase of the operation of the machine. Following this phase, the drive arm is returned to the position of FIG. 5A, with the injection spoon fully retracted and the reciprocating compacting member returned to its fully opened position (FIG. 6A).

The compaction and injection cycle of the cigarette making machine is initiated by on-off switch 15 which causes motor 140 to rotate, driving gears 130 and 92. A sensor 202 is positioned as shown, for example, in FIGS. 6A-6D so that when the injection spoon drive arm reaches its rest position as shown in FIG. 6A, lip 152 enters the slot 204 in sensor 202, stopping the flow of current to the motor and causing the machine to come at rest in this position. The current flow will be restored when it is again desired to produce a cigarette by pressing push button switch 15.

Figure 7:
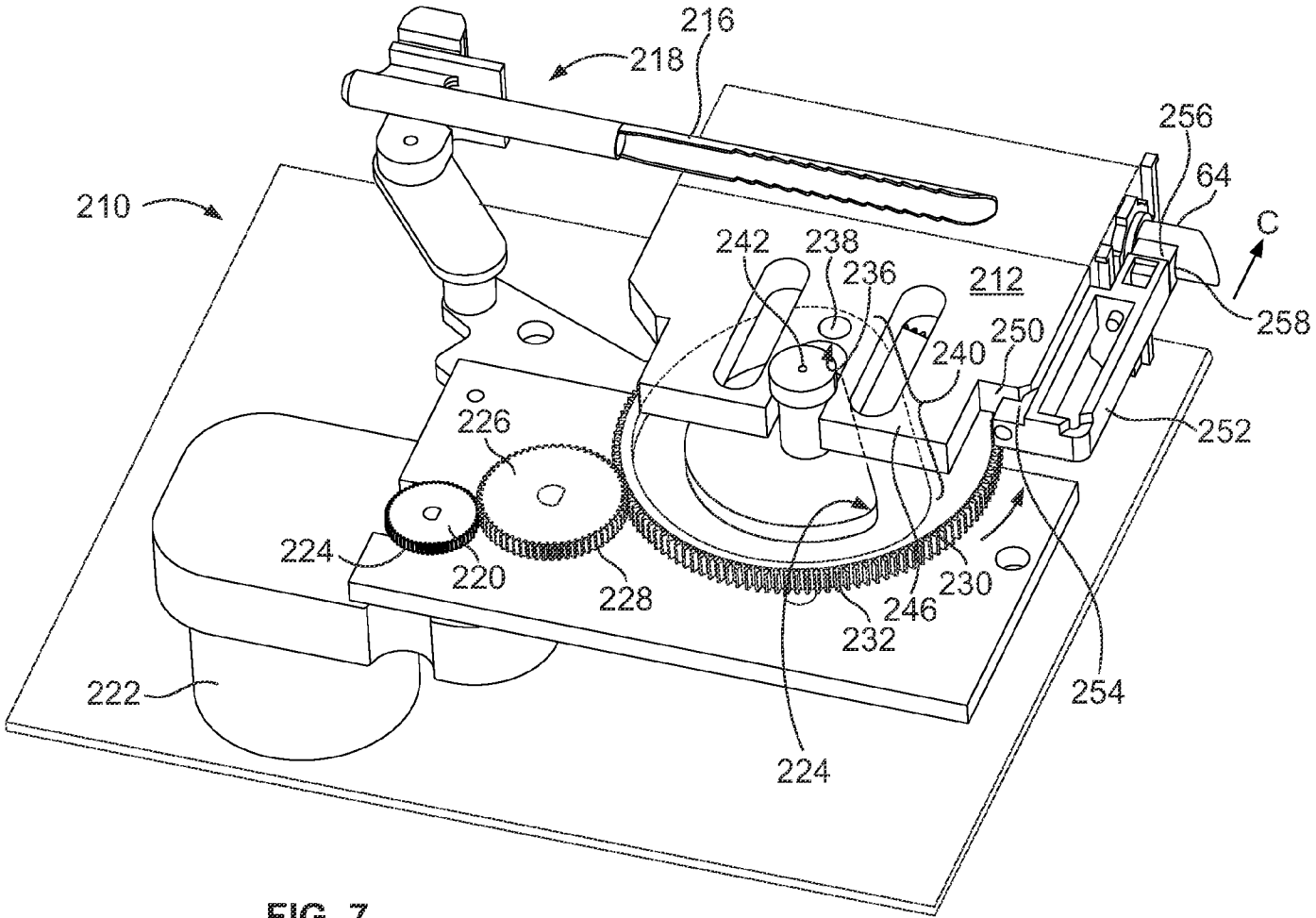
FIG. 7 is a perspective view of an alternative embodiment using three drive wheels and a modified drive slot in an alternative dual purpose control gear.

Turning now to FIG. 7, an alternative embodiment of a cigarette-machine 210 is shown. This embodiment is generally consistent with that of the above described embodiment. Thus, this embodiment includes a reciprocating compacting member 212 similar in design and operation to compacting member 68 above. This alternative embodiment also includes a drive mechanism 214, an injection spoon drive arm 216 and associated pins and links shaped and operating generally in the same fashion as injection spoon drive arm 144 above and its pins and links. Finally, this alternative embodiment includes an injection spoon assembly 218 structured and operating like injection spoon 168 of the above embodiment.

In the embodiment of FIG. 7, however, a drive wheel 220 is keyed to motor 222. The teeth 224 of this drive wheel engage the teeth 228 of an intermediate drive wheel 226 which in turn engage the outer gear teeth 232 of dual purpose control gear 235.

Finally, and most importantly, dual control gear wheel 230 includes "D" shaped slot 234 which is offset from the center of rotation 242 of the gear. In this slot, point 236 which is the closest location along the slot to the center of rotation serves as the slot rest point. When pin 238 of the reciprocating member is at this location, before operation of the machine, the injection spoon assembly is in its fully retracted or rest position and the reciprocating compacting member sits adjacent the top of the compacting chamber and away from the injection spoon. As the motor is operated, control gear 230 rotates in a counter-clockwise direction moving first leg 240 of the slot along the pin causing the pin to move away from the center of rotation 242 of the gear, thereby causing the reciprocating compacting member to move toward the bottom of the compacting chamber.

When the slot is rotated to the position where pin 238 is at transition point 244, the reciprocating compacting member is maintained in its fully engaged compacting position within the compacting chamber. As the control gear continues to rotate pin 238 is maintained within a straight segment 246 of the slot extending between transition point 244 and rest point 236. As the gear rotates and hence the slot continues to move along the pin, the injection spoon assembly will be advanced under the operation of the injection spoon drive arm which is attached to the bottom surface of the gear control with a structure that operates as injection spoon drive arm 144 above. Once the injection spoon is in the fully advanced position (so that the tobacco) has been injected into the external preformed tube) pin 238 will be at rest point 236. Further rotation of the gear beyond this point will simultaneously retract the injection spoon assembly and withdraw the reciprocating compacting member from the compacting chamber to complete a cycle of operation of the machine.

Reciprocating compacting members 68 and 212 include a tube holding mechanism which may be used in the embodiment of FIGS. 1-6D but is best illustrated in FIG. 7. The tube holding mechanism thus includes a ledge 250 on the reciprocating compacting member and a spring loaded/pressure applying member 252 which engages the ledge at a protuberance 254 at the distal end of the member. This pressure applying member includes an elastomeric tip 256 with a circular cavity 258 having a radius corresponding to the outer radius of cigarette-tube receiving nipple 64. Thus, during the operation of the machine, when the reciprocating compacting member is in the retracted position shown in FIG. 7, surface 258 of tip 256 is spaced from the surface of the nipple so that a preformed cigarette tube may be slid onto the nipple. As the reciprocating compacting member moves into its compaction position, surface 258 will move away from nipple 64 so that the arm will move in direction "C" causing the tip to engage and retain the tube on the nipple while compaction and injection process proceeds. When the reciprocating compacting member is retracted and returns to the position depicted in FIG. 7, member 252 is also retracted so that the now-filled cigarette tube may be easily removed from the nipple.

In another aspect, a method of using the improved injector-type cigarette-making machine is provided. First, a paper cigarette tube is disposed on nipple 64. Initially, the machine is ready to accept a portion of loose tobacco by directing an appropriate quantity of the loose tobacco down funnel portion 20 and into tobacco compacting chamber 41 Once the tube and tobacco are properly in place, the user presses switch 15 which initiates the operation of motor 140 causing dual purpose control gear 92 to rotate as described above. The rotation of the control gear first moves reciprocating compacting member 68 into tobacco compacting chamber 41 to compact the tobacco therein between the front compacting edge 74 of the compacting member and the half round surface of injection spoon 62.

As the reciprocating compacting member reaches this fully closed position, control gear 92 continues to rotate about its axle moving injection spoon 62 through the compaction chamber to carry the compacted tobacco through nipple 64 and into a hollow cigarette tube positioned on the nipple. The reciprocating compacting member is maintained at or near its fully closed position during this movement of the injection spoon.

Once the compacted tobacco has been transported into the cigarette tube, the still rotating control gear withdraws the reciprocating compacting member from the compaction chamber while withdrawing the injection spoon from the cigarette tube. The withdrawal of the reciprocating compacting member also releases a clamping mechanism holding the cigarette tube on the nipple so that the now tobacco filled tube may be removed from the machine.

Once the control gear has completed this cycle, power to the motor is cut by a limit-type switch so that the cigarette making machine comes to rest and is ready to prepare another filled cigarette tube.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A cigarette-making machine comprising:

a housing including a surface having an aperture;

a compacting chamber in communication with the aperture for receiving loose tobacco;

a compacting member mounted for reciprocal up and down motion from an initial position adjacent the top of the compacting chamber toward the bottom of the compacting chamber to compact loose tobacco in the compacting chamber into a rod-like shape and away from the rod-like compacted tobacco shape;

a nipple for receiving a hollow cigarette tube disposed outside and adjacent an ejection side of the compacting chamber;

an injection spoon mounted for reciprocal lateral movement from a rest position within the compacting chamber across the compacting chamber to transport the rod-like compacted tobacco shape past the delivery side of the compacting chamber, through the nipple and into a hollow cigarette tube;

an electrically powered motor;

a dual purpose control disk having an axle positioned along its central axis adapted to be rotated about its axis by the motor, the disk having opposed outer first and second faces;

the compacting member being coupled to a first member associated with the first face of the control disk that moves the compacting member up and down in the compacting chamber as the control disk is rotated by the motor; and the injection spoon being coupled to a second member associated with the control disk axle that moves the injection spoon across the compacting chamber as the control disk is rotated by the motor;

wherein the first and second members are positioned respectively on the front face of the control disk and on the control disk axle to first move the compacting member toward the bottom of the compacting chamber to compact loose tobacco in the compacting chamber into a rod-like shape and then to move the injection spoon across the compacting chamber to transport the rod-like compacted tobacco shape past the ejection side of the compacting chamber, through the nipple and into a hollow cigarette tube, and the first member on the first face of the control disk comprises a heart-shaped drive slot and a pin that moves within the drive slot as the control disk is rotated.

2. The cigarette-making machine of claim 1 in which the first and second members are further positioned respectively on the front face of the control disk and on the control disk axle to move the compacting member away from the rod-like compacted tobacco shape before the injection spoon moves across the compacting chamber to transport the rod-like compacted tobacco shape past the ejection side of the compacting chamber, through the nipple and into a hollow cigarette tube.

3. The cigarette-making machine of claim 2 in which the first and second members are further positioned respectively on the front face of the control disk and on the control disk axle to return the compacting member to its initial position and the injection spoon to its rest position after the rod-like compacted tobacco shape is positioned in the hollow cigarette tube.

4. The cigarette-making machine of claim 1 in which the heart-shaped slot includes a rest point where the slot dips to a location closest to the center of rotation of the disk, a first portion of the slot lying between the rest portion and a first transition point comprising an arc curling up and away from the center of rotation, a maintenance segment of the slot running between the first transition point and a second transition point maintaining the pin at a generally uniform distance from the center of rotation of the disk and a reopening portion of the slot where the slot curves inwardly toward the center of rotation of the disk to cause the reciprocating connecting member to move upwardly in the tobacco compacting chamber, away from the compacted tobacco shape.

5. The cigarette-making machine of claim 1 in which the slot is "D" shaped and offset from the center of rotation of the disk.

6. The cigarette-making machine of claim 5 in which the "D" shaped slot has a rest point that is the closest location along the slot to the center of rotation of the disk to position the reciprocating compacting member adjacent to the top of the compacting chamber, a first straight leg causing the pin to move away from the center of rotation of the disk thereby causing the reciprocating compacting member to move toward the bottom of the compacting chamber, a transition point leading into a curved section where the reciprocating compacting member is returned from its fully engaged compacting position to its rest position.

7. The cigarette-making machine of claim 1 including an injection spoon drive arm coupled to the axle of the control disk and to the injection spoon for moving the injection spoon in a reciprocating lateral motion.

8. The cigarette-making machine of claim 1 in which the control disk is a gear having gear teeth along its circumference and the motor has a drive gear for engaging the control gear teeth.

9. The cigarette-making machine of claim 1 including a funnel portion with an inclined surface adjacent the aperture for directing loose tobacco into the compacting chamber.

10. The cigarette-making machine of claim 9 in which the funnel portion includes at least one side wall angled toward the aperture.

11. The cigarette-making machine of claim 1 in which the compacting member includes a leading concave compacting edge to help form the top of the compacted tobacco a rod-like shape.

12. The cigarette-making machine of claim 1 in which:

the axle includes a downwardly directed keyed shaft having a flat to provide a keying function and a link arm keyed to the shaft having a drive pin;

the injection spoon drive arm has a longitudinal slot for receiving the link arm pin so that the pin moves back and forth along the slot as the drive arm rotates causing the injection spoon drive arm to swing about a pivot point adjacent to the distal end of the arm at which it is rotatedly fixed; and a switch for turning the machine on and a sensor for the determining when the injection spoon drive arm reaches a position with the injection spoon in its rest position in the compacting chamber to stop the flow of current to the motor.

13. The cigarette-making machine of claim 12 in which the drive pin is a bearing-mounted rotatable pin for minimizing friction as the pin moves in the slot.

14. The cigarette-making machine of claim 1 including an injection spoon assembly having a carriage portion to which a tubular spoon base is attached and the injection spoon comprises an approximately half round open tube portion projecting from the spoon base, the spoon base being plugged adjacent the half round open tubular portion.

15. The cigarette-making machine of claim 14 in which the carriage portion of the assembly includes a lateral tracking means for engaging a tracking support to maintain the movement of the injection spoon of the assembly to reciprocal lateral movement.

16. The cigarette-making machine of claim 1 including a tube holding mechanism having a pressure-applying member with a elastomeric tip for engaging a portion of a hollow cigarette tube applied to the nipple to hold the tube in place on the nipple.

* * * * *